US006467415B2

(12) United States Patent
Menzel et al.

(10) Patent No.: US 6,467,415 B2
(45) Date of Patent: Oct. 22, 2002

(54) LINEAR IGNITION SYSTEM

(75) Inventors: Doug Menzel, Hollister; Stanley Rodney, Morgan Hill, both of CA (US)

(73) Assignee: McCormick Selph, Inc., Hollister, CA (US)

( * ) Notice: Subject to any disclaimer, the term of this patent is extended or adjusted under 35 U.S.C. 154(b) by 0 days.

(21) Appl. No.: 10/079,486

(22) Filed: Feb. 22, 2002

(65) Prior Publication Data

US 2002/0088363 A1 Jul. 11, 2002

Related U.S. Application Data

(62) Division of application No. 09/635,489, filed on Aug. 9, 2000.

(51) Int. Cl.[7] ..... F42B 3/14; C06C 5/04

(52) U.S. Cl. ..... 102/275.7; 102/202.8; 102/275.1; 102/275.4; 102/275.8

(58) Field of Search ..... 102/275.11, 275.1, 102/275.5, 275.4, 275.8, 202.3, 275.9, 275.7, 275.6; 112/202.8

(56) References Cited

U.S. PATENT DOCUMENTS

| | | | |
|---|---|---|---|
| 4,070,970 A | | 1/1978 | Scamaton |
| 4,312,271 A | | 1/1982 | Day et al. |
| 4,422,381 A | | 12/1983 | Barrett |
| 4,846,067 A | | 7/1989 | Martin |
| RE33,202 E | | 4/1990 | Janoski |
| 4,917,017 A | | 4/1990 | Beltz |
| 4,976,200 A | | 12/1990 | Benson |
| 4,998,477 A | | 3/1991 | Barker |
| 5,010,821 A | | 4/1991 | Blain |
| 5,031,538 A | | 7/1991 | Dufrane et al. |
| 5,036,769 A | | 8/1991 | Schaff et al. |
| 5,115,743 A | | 5/1992 | Löffler |
| 5,225,621 A | | 7/1993 | Kannengiesser et al. |
| 5,327,835 A | | 7/1994 | Adams et al. |
| 5,333,550 A | | 8/1994 | Rodney et al. |
| 5,392,713 A | | 2/1995 | Brown et al. |
| 5,417,162 A | | 5/1995 | Adams et al. |
| 5,540,154 A | | 7/1996 | Wilcox et al. |
| 5,594,196 A | | 1/1997 | Rotney et al. |
| 5,929,367 A | | 7/1999 | Neff et al. |
| 5,998,477 A | | 12/1999 | Sperl et al. |
| 6,062,143 A | * | 5/2000 | Grace et al. |

* cited by examiner

*Primary Examiner*—Michael J. Carone
*Assistant Examiner*—Lulit Semunegus
(74) *Attorney, Agent, or Firm*—Robert E. Bushnell, Esq.

(57) ABSTRACT

A linear ignition system for a metal-sheathed linear explosive including in one embodiment the ends of two metal-sheathed linear explosives are connected by a non-electrically conductive sleeve leaving a gap between the ends, and a Pyrofuze® bridge connects the metal-sheath of one end to the metal sheath of the other end. Electrical contacts are made to the two metal sheaths and application of current to the electrical contacts ignites the Pyrofuze® bridge and the linear explosives. Embodiments can also include an explosive mixture in the gap, using a hotwire bridge, or including booster increments for initiating detonating explosives. The linear ignition systems offer robust, easy-to-install linear explosive devices for applications in automotive, commercial or military aircraft safety systems, other military and aerospace applications, and commercial blasting.

13 Claims, 8 Drawing Sheets

LINEAR IGNITION SYSTEM

CROSS-REFERENCE TO RELATED APPLICATIONS

This application refers to and relates to Disclosure Document No. 472328 filed in the U.S. Patent & Trademark Office on Apr. 12, 2000. This application is a divisional application of U.S. application Ser. No. 09/635,489, filed in the U.S. Patent & Trademark Office on the day of Aug. 9, 2000, U.S. application Ser. No. 09/635,489 being incorporated herein by reference. Also, this application makes reference to, incorporates the same herein, and claims priority and all benefits accruing under 35 U.S.C. §120 from the aforementioned U.S. application Ser. No. 09/635,489, filed on the day of Aug. 9, 2000, entitled Linear Ignition System.

BACKGROUND OF THE INVENTION

1. Field of the Invention

The present invention relates to the field of explosives, in particular to igniting devices, and more particularly to igniting devices for metal-sheathed linear explosives and pyrotechnics.

2. Description of the Related Art

Linear explosive and pyrotechnic products, such as Linear Shaped Charge (LSC), Mild Detonating Cord (MDC) and Rapid Deflagrating Cord (RDC) are typically initiated using a separate, distinct, electrically initiated ignition device to provide either a brisant, pyrotechnic or high order shock stimulus for the linear explosive material. Of particular interest are linear shaped charge, mild detonating cord and rapid deflagrating cord devices contained within a metal sheath. Linear shaped charge devices having an explosive wrapped in a continuous metallic sheath are commonly used for severing materials. Sheathed mild detonating cord is used to transfer an explosive stimulus in a contained manner and may be used to instantaneously shear certain structures. These products have potential applications in a wide range of applications, such as automotive and commercial aircraft safety systems, aircrew escape and safety systems, military weapon system ignition, event sequencing and submunition dispensing, launch vehicle event sequencing, and various commercial blasting and oilfield applications.

Generally, in such systems, the linear pyrotechnic or explosive device is provided separately from, and must be mounted and installed with, a separate initiation (ignition) device. However, the use of a separate ignition device increases the cost and complexity of the use of these systems. These devices generally must be installed with an adapter to the linear pyrotechnic device, and the installation of the separate ignition device requires labor, adding to the cost. Moreover, with separate ignition devices, there is often a possibility for a mistake in installation, such as failure to remove the safety cap. For failsafe systems, testing of the installed ignition device may also be difficult.

Moreover, conventional initiators or detonators have some risk of accidental initiation due to electrostatic discharge (ESD) or electromagnetic radiation, which is an important safety and handling issue. In addition, most conventional initiation devices have a lifetime which may be considerably shorter than that of the linear pyrotechnic or explosive, therefore limiting the life of the installed system.

Examples of the conventional art of initiating devices are seen in the following U.S. patents. U.S. Pat. No. 4,070,970, to Scamaton, entitled ELECTRO-EXPLOSIVE IGNITERS, describes an electrically initiated igniter having a layer of pyrotechnic mixture packed between two initiating electrodes. This is a separate device from the actual explosive, and is for non-brisant initiation; a detonator capsule must be attached for brisant ignition.

U.S. Pat. No. 4,312,271, to Day et al., entitled DELAY DETONATION DEVICE, describes a delay detonator device having a bridge wire which ignites a delay charge.

U.S. Pat. No. 4,422,381, to Barrett, entitled IGNITER WITH A STATIC DISCHARGE ELEMENT AND FERRITE SLEEVE, describes an electroexplosive device with a cylindrical electrically conductive metal casing which is open at one end, and which has a bridge element and lead wires.

U.S. Pat. No. 4,976,200, to Benson et al., entitled TUNGSTEN BRIDGE FOR THE LOW ENERGY INITIATION OF EXPLOSIVE AND ENERGETIC MATERIALS, describes a device fabricated on a silicon-on-sapphire substrate.

U.S. Pat. No. 5,036,769, to Schaff et al., entitled PYROFUZE PIN FOR ORDNANCE ACTIVATION, describes a device designed to avoid accidental arming of ordnance, and having a Pyrofuze pin, a connecting ignitor transfer charge, ignitor and electrical terminals in a weatherproof housing.

U.S. Pat. No. 5,225,621, to Kannengiesser et al., entitled PROCESS FOR PRODUCING A JACKETED FUSE AND FUSE PRODUCT, describes a fuse with a jacket produced from a shrinkable hose which is shrink-fitted onto unfinished cord containing an explosive.

U.S. Pat. No. 5,392,713, to Brown et al., entitled SHOCK INSENSITIVE INITIATING DEVICES, describes a device which has a thin elongated metal casing containing a quantity of hydrated metal picrate and an ignition means which may be an electric match.

Based on our reading of the art, then, we have decided that what is needed is an improved system for initiation of linear pyrotechnic devices.

SUMMARY OF THE INVENTION

It is therefore an object of the present invention to provide an improved ignition device for metal-sheathed linear explosives and pyrotechnics.

It is a further object of the invention to provide a less complex ignition device.

A still further object of the invention is to provide a linear initiation system which is easier to install.

A yet further object of the invention is to provide a linear initiation system which is less expensive.

Another object of the invention is to provide a linear initiation system which has a longer service life.

Yet another object of the invention is to provide a linear initiation system which is less susceptible to electrostatic discharge and electromagnetic radiation.

Still another object of the invention is to provide a linear initiation system which is more reliable.

These objects are achieved in the linear ignition system of the present invention. One embodiment of the present invention includes two metal-sheathed linear explosives, the ends of which are connected by a non-electrically conducting sleeve leaving a gap between the ends. Bridging this gap is a bridge made from an exothermic metal composition, and electrical contacts are made to each of the metal sheaths of the two linear explosives. Upon application of voltage, current flows through the sheaths, ignites the bridge, when in turn ignites the linear explosive. Here, the term "explosive" is used generally, and covers high explosives which detonate, low explosives which are classed as mild or rapid deflagrating materials, as well as pyrotechnics.

Additional embodiments are presented in which booster increments are included placed against each end of the linear explosive to allow initiation of explosives requiring detonation. Embodiments are described in which an explosive material is included in the gap, and in some embodiments, a hotwire bridge is used instead of the exothermic metal composition.

In another embodiment, the ends of two metal-sheathed linear explosives are connected by a non-conducting sleeve, leaving an unbridged air gap between the ends. Here, application of sufficient voltage across the metal sheaths leads to a spark in the gap, causing ignition. In another embodiment, the gap contains an explosive material. It is also possible to have booster increments on the end of each linear explosive and to provide electrical contacts around the booster increments with the gap formed between the booster increments. In this embodiment, the spark would occur in the gap between the booster increments and ignite the booster increments.

In another embodiment of the invention, a single metal-sheathed linear explosive is covered at one end by an insulating sleeve and a metal end cap over the sleeve, forming a gap between the end of the linear explosive and the inside end of the end cap. A bridge made of an exothermic material extends across the gap within the end cap from the metal sheath to the metal end cap. Electrical contacts are made to the metal end cap and the metal sheath for ignition of the bridge to ignite the linear explosive. Additional embodiments having the end cap are presented in which a booster increments is placed against each the end of the linear explosive, in which an explosive material is included in the gap, or in which a hotwire bridge is used instead of the exothermic metal composition.

Embodiments are also described in which no bridge is present in the gap between the end cap and the end of the linear pyrotechnic, and in which the gap serves as a spark gap. Here, a booster element or an explosive mixture in the gap may also be provided.

BRIEF DESCRIPTION OF THE DRAWINGS

A more complete appreciation of the invention, and the attendant advantages, thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1A:
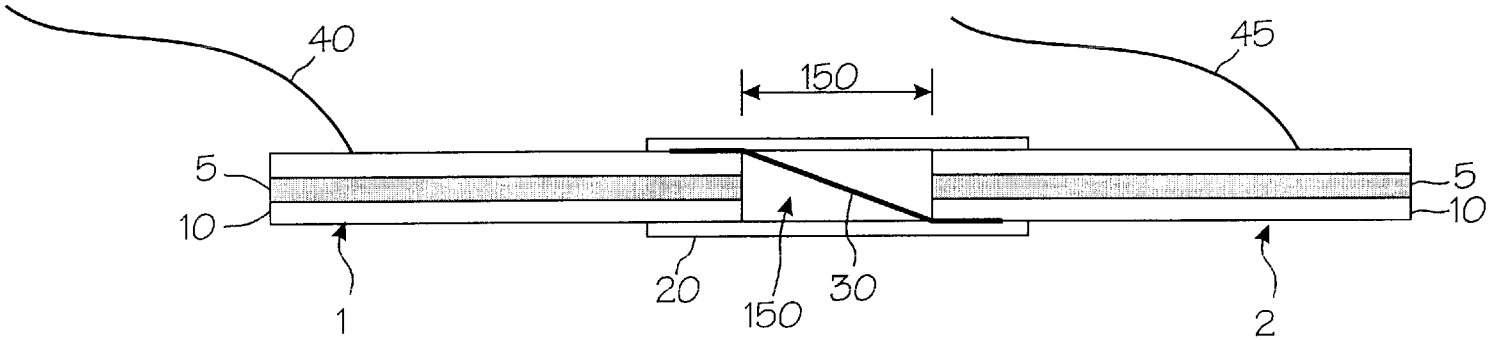
FIG. 1A is a longitudinal cross-section of an embodiment of the present invention having an in-line configuration.

Referring now to the drawings, one embodiment of the present invention is shown in FIG. 1A. In FIG. 1A, two metal-sheathed linear pyrotechnics 1 and 2 each have a metal sheath 10 and an explosive material 5 in an in-line configuration. In describing the present invention the term "explosive" is used generally, and covers high explosives which detonate, low explosives which are classed as mild or rapid deflagrating materials, as well as pyrotechnics. The metal-sheathed linear explosive may be a linear shaped charge, mild detonation cord or rapid deflagration cord, as discussed above. Sleeve 20 partially covers the metal sheaths 10 near the ends of the two metal-sheathed linear explosives 1 and 2, leaving gap 50 between the ends. Sleeve 20 is made from a non-electrically conductive material, and may be made of shrink tubing.

Inside sleeve 20 and bridging gap 150 is bridge 30, which is made from an exothermic metal composition, that is, a composition which rapidly reacts to produce a high temperature when electricity is passed through the wire. The wire may be made, for example, of Pyrofuze®, which is an alloy of palladium metal with ruthenium over an inner core of aluminum. To ignite the device, electrical contacts 40 and 45 are attached respectively to the sheaths 10 of linear explosives 1 and 2. The electrical contacts may be soldered, clamped, or connected by other means known in the art, to the metal sheaths. For convenience of installation, for example, solder rings (not shown) may be provided on the metal sheaths. The electrical contacts are shown as wires in the Figures, but they need not be independent wires. For example, one of the sheaths might be connected to a chassis ground.

During ignition, electric current is passed through the electrical contacts 40 and 45 and correspondingly through sheaths 10 and bridge 30. Bridge 30 rapidly heats to an initiation temperature of approximately 1200° F. and produces high velocity particles with temperatures in the range of 5000° F. which initiate the energetic material of the linear explosives. Generally, the exothermic reaction of an exothermic metal composition is suitable for initiating deflagrating materials, and this embodiment would generally be used, for example, with rapid deflagrating cord as the linear explosive.

An advantage of the present invention is that, because the Pyrofuze® bridge requires a high firing current, the bridge is not ignited by electrostatic discharge (ESD) or electromagnetic radiation (EMR). As a result, this invention offers a significant margin of safety and offers reduced cost of use due to a simplified ignition procedure with fewer necessary safeguard steps.

Another advantage of the present invention is that it uses the metal sheathing of the linear explosive as part of the electrical conductor for the initiation device. This provides a robust connection and may serve to simplify the wiring of the installed device.

Figure 1B:
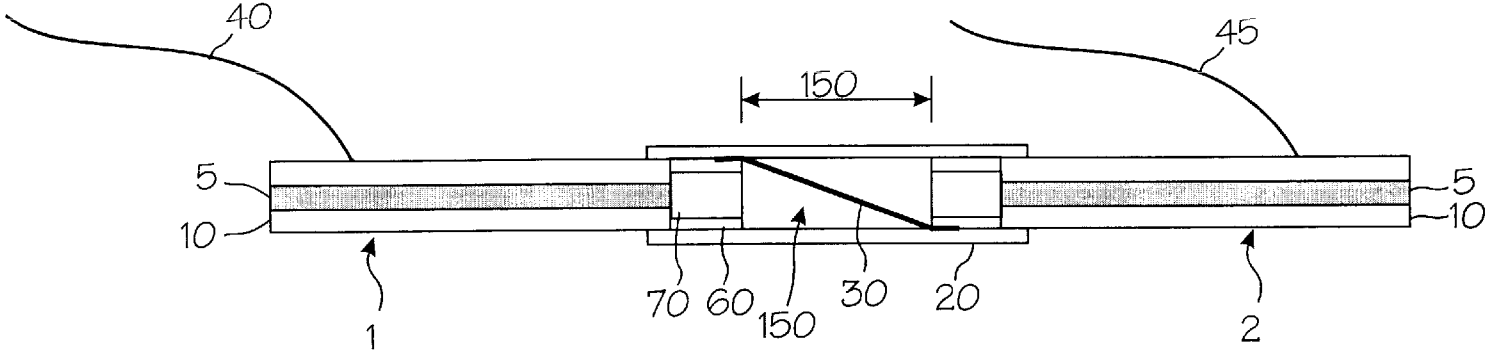
FIG. 1B is a longitudinal cross-section of an embodiment of the present invention having an in-line configuration and booster increments.

A variation on the linear in-line configuration of FIG. 1A is shown in FIG. 1B. This embodiment also includes two metal-sheathed linear explosives 1 and 2 each including sheath 10 and explosive material 5, shrink tube 20 and bridge 30, as well as the electrical contacts 40 and 45 attached to the respective sheaths 10. In this embodiment, a booster increment 70 surrounded by metal sheath 60 is placed at the end of each linear explosive 1 and 2 in the shrink tube or sleeve 20 with the bridge 30 electrically connecting and electrically coupling the sheaths 10 of linear explosives 1 and 2. Booster increment 70 may be any typical booster or prime charge material, such as a pressed explosive of lead azide, lead styphnate, etc. The embodiment shown in FIG. 1B would generally be used when a detonating linear explosive is used, as these secondary explosives generally require a detonation for initiation, and upon application of current through contacts 40 and 45 the bridge 30 heats and causes initiation of the booster increments 70 to ignite linear explosives 1 and 2.

Figure 2A:
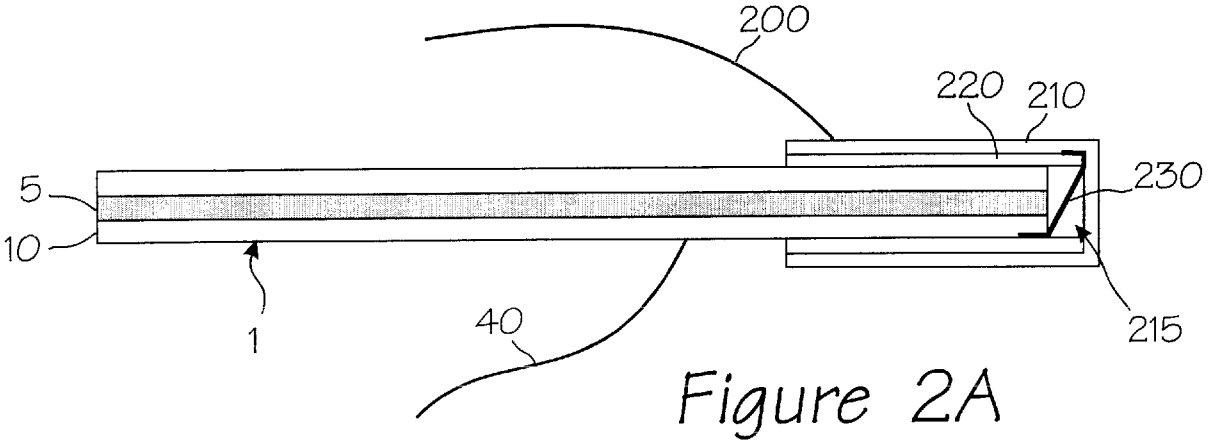
FIG. 2A is a longitudinal cross-section of an embodiment of the present invention having an end initiation configuration.

Another embodiment of the present invention in which the initiation occurs at the end of one linear explosive device, is shown in FIG. 2A. In this embodiment, on one end of metal-sheathed linear explosive 1 is metal end cap 210, linear explosive 1 including a sheath 10 and explosive material 5. Under metal end cap 210 is insulating sleeve 220, which prevents electrical contact between end cap 210 and sheath 10 of linear explosive 1. The end cap 210 is placed so as to leave a small gap 215 between the end of metal end cap 210 and the end of linear explosive 1. Bridge 230 is placed in this gap 215, one end of bridge 230 contacting sheath 10, and this end may be sandwiched between sheath 10 and insulating sleeve 220. The other end of bridge 230 contacts the metal end cap 210, and maybe sandwiched between metal end cap 210 and sleeve 220. Bridge 230 is made from exothermic metal composition, such as Pyrofuze®. Electrical contacts 40 and 200 are attached respectively to sheath 10 and metal end cap 210, and thus upon application of current that passes through electrical contacts 40 and 200, bridge 230 rapidly heats and ignites the end of linear explosive 1.

Figure 2B:
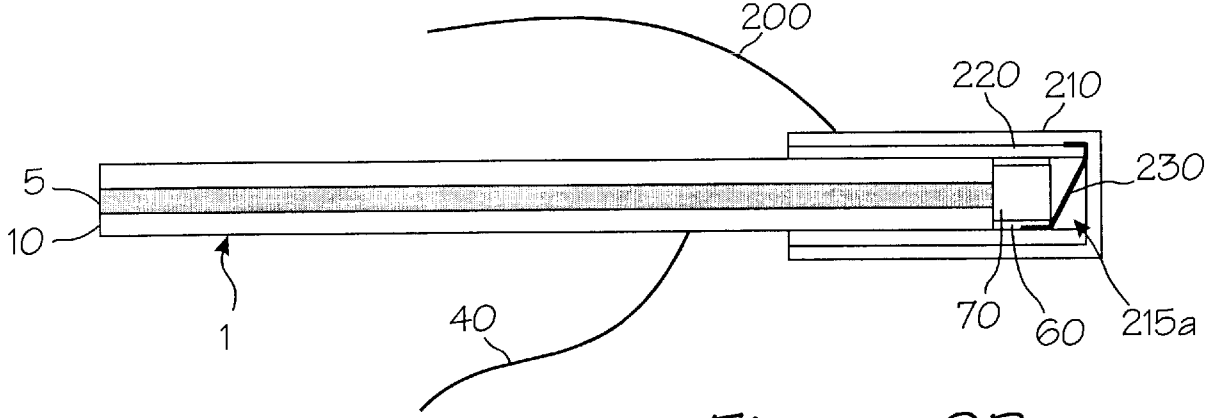
FIG. 2B is a longitudinal cross-section of an embodiment of the present invention having an end initiation configuration and booster increments.

An alternative embodiment of the configuration of FIG. 2A is shown in FIG. 2B. Here, a booster increment 70 is placed on the end of linear explosive 1 inside the sleeve 220, linear explosive 1 including the metal sheath 10 and explosive material 5. Electrical contact 60 is provided between sheath 10 and bridge 230, and this electrical contact 60 may be a metal sheath around booster increment 70. In this embodiment, upon application of current that passes through electrical contacts 40 and 200, bridge 230 in gap 215*a* rapidly heats and initiates the booster increment 70, which in turn initiates the end of linear explosive 1. As noted above, this configuration using a booster would generally be used with a detonating linear explosive.

Figure 3A:
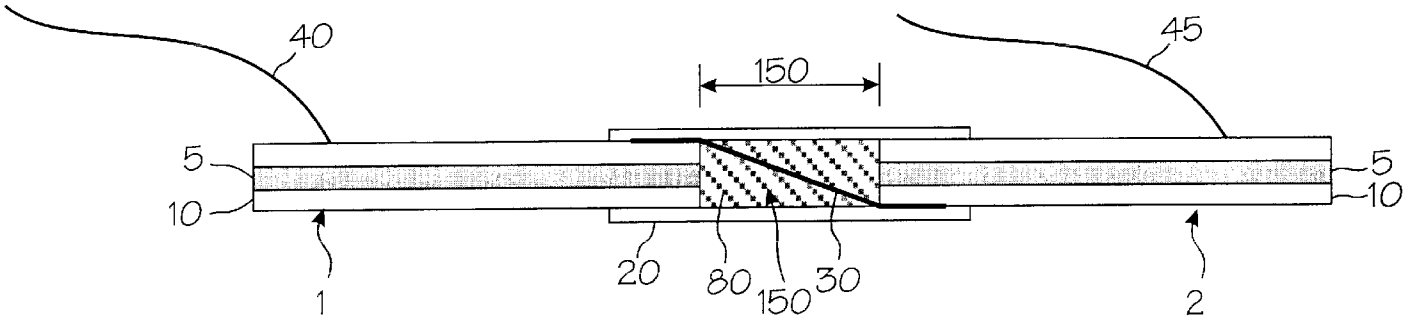
FIG. 3A is a longitudinal cross-section of an embodiment of the present invention having an in-line configuration with a Pyrofuze bridge and an explosive mixture.
Figure 3B:
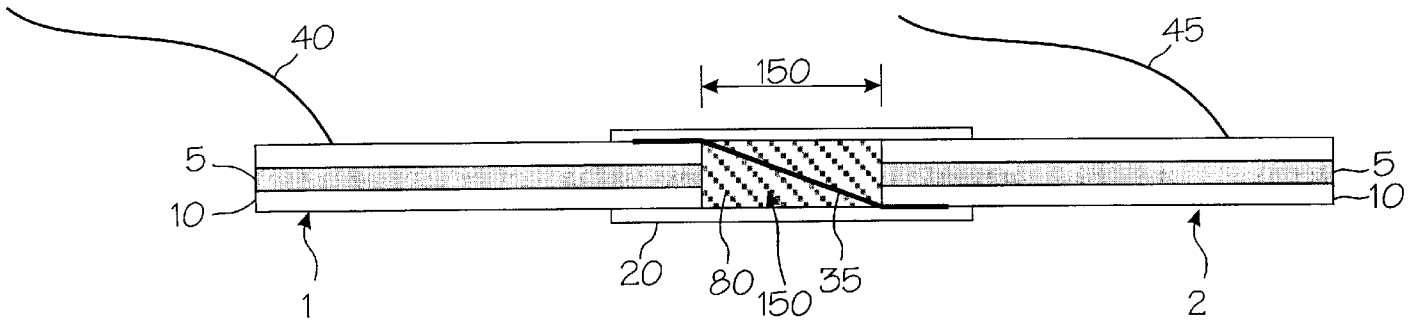
FIG. 3B is a longitudinal cross-section of an embodiment of the present invention having an in-line configuration with a hot-wire bridge and an explosive mixture.

Another embodiment of the invention using an in-line configuration is shown in FIG. 3A. The embodiment is related to that shown in FIG. 1A. In the embodiment shown in FIG. 3A, however, the gap 150 inside sleeve 20 between the ends of metal-sheathed linear explosives 1 and 2 contains explosive mixture 80, linear explosive 1 and 2 each including a sheath 10 and explosive material 5. In FIG. 3A, bridge 30 is made of an exothermic metal composition. An alternative embodiment is shown in FIG. 3B, In which bridge 35 is made of a hot-wire, that is, a wire which heats up when current is applied but does not itself react exothermically. Here, in the embodiments of FIG. 3A an 3B, upon application of current through electrical contacts 40 an 45, bridge 30 or 35 becomes hot and ignites the explosive mixture 80, which in turn ignites the metal-sheathed linear explosives 1 and 2. Any of a variety of explosives or pyrotechnics, for example a borohydride composition, may be used for explosive mixture 80.

Figure 4A:
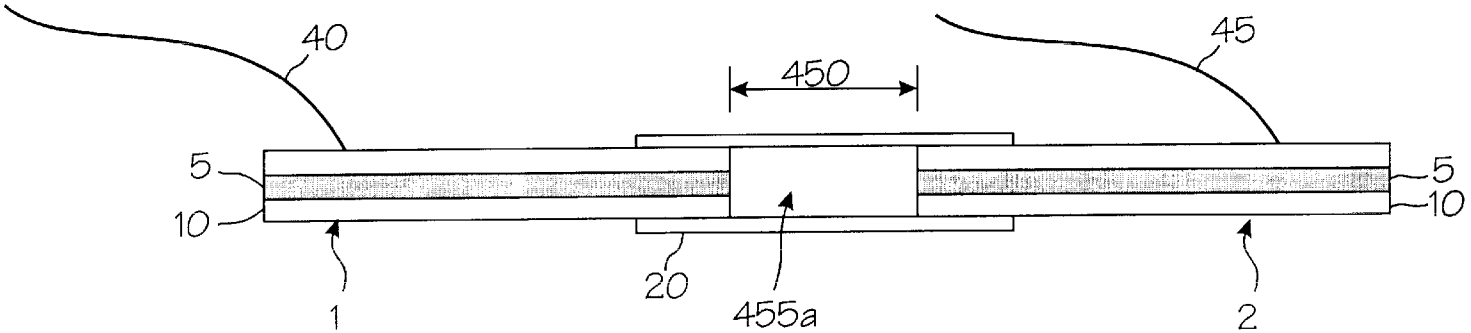
FIG. 4A is a longitudinal cross-section of an embodiment of the present invention having an in-line spark gap configuration.

FIG. 4A illustrates another embodiment of the present invention. In this embodiment, metal-sheathed linear explosives 1 and 2 each including a sheath 10 and explosive material 5 are connected by sleeve 20 made of non-conductive material. The ends of linear explosives 1 and 2 are separated by an air gap 450*a* of dimension indicated by arrow 450. Upon application of voltage to and current that passes through electrical contacts 40 and 45, a spark jumps the air gap 450*a* and produces sufficient energy to ignite the linear explosives 1 and 2. The dimension of the air gap 450*a* determines how much voltage must be applied to initiate the device, with greater lengths requiring greater voltages. The air gap may, for example, be in the range of 0.020 to 0.050 inch. To manufacture a device with such an air gap, an insulative spacer (not shown) may be included between the ends of the linear explosives 1 and 2.

Figure 4B:
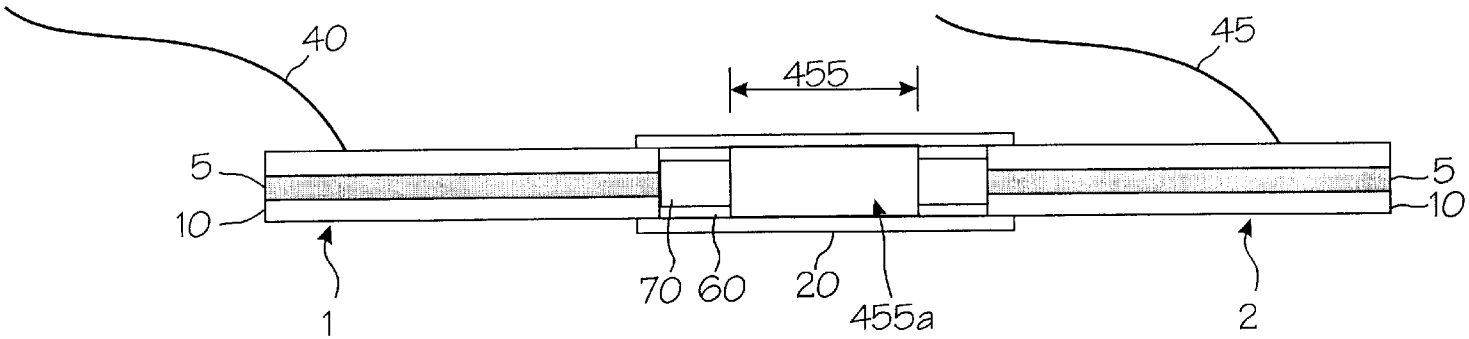
FIG. 4B is a longitudinal cross-section of an embodiment of the present invention having an in-line spark gap configuration with booster increments.

FIG. 4B illustrates an alternative embodiment of that shown in FIG. 4A. In FIG. 4B, a booster increment 70 is placed on the ends of linear explosives 1 and 2 inside the sleeve 20, the linear explosives 1 and 2 each including a sheath 10 and explosive material 5. Booster 70 is surrounded by metal sleeve 60, and the gap 455*a* between the ends of the boosters 70 and their metal sleeves 60, across which a spark will jump when current is passed through electrical contacts 40 and 45 respectively connected to sheaths 10 of linear explosives 1 and 2, is indicated by arrow 455.

Figure 5:
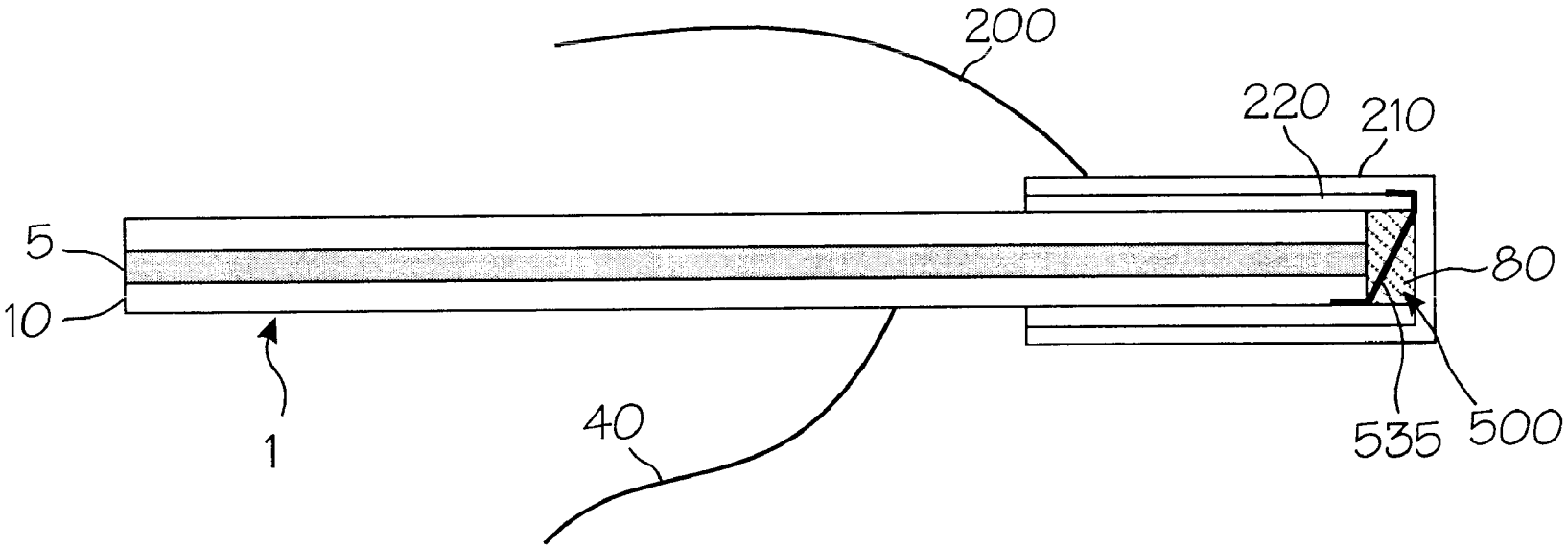
FIG. 5 is a longitudinal cross-section of an embodiment of the present invention having an end initiation configuration.

FIG. 5 illustrates an embodiment which is a linear ignition end initiation configuration. Here, the metal-sheathed linear explosive 1 has metal end cap 210 and insulating sleeve 220 between linear explosive 1 and metal end cap 210, linear explosive 1 including a sheath 10 and explosive material 5. The end cap 210 is placed so as to leave a small gap 500 between the end of metal end cap 210 and the end of linear of explosive 1, and this gap 500 contains explosive material 80. Bridge 535 is placed in this gap 500, one end of bridge 535 contacting sheath 10, and this end of bridge 535 may be sandwiched between sheath 10 and insulating sleeve 220. The other end of bridge 535 contacts the metal end cap 210, and may be sandwiched between metal end cap 210 and sleeve 220. Upon application of current through electrical contacts 40 and 200, bridge 535, such as a hotwire bridge, becomes hot and ignites the explosive mixture, which in turn ignites the metal-sheathed linear explosive 1.

Figure 6A:
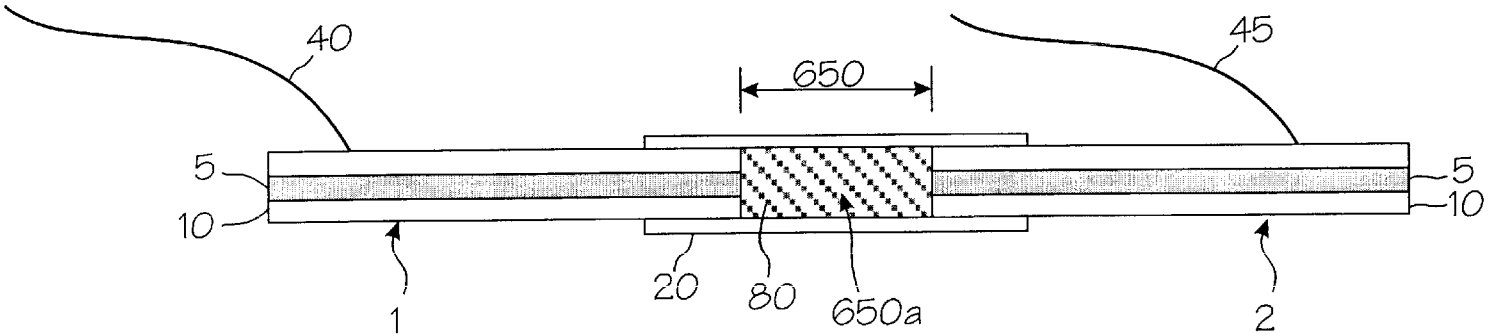
FIG. 6A is a longitudinal cross-section of an embodiment of the present invention having an in-line spark gap configuration with an explosive mixture.
Figure 6B:
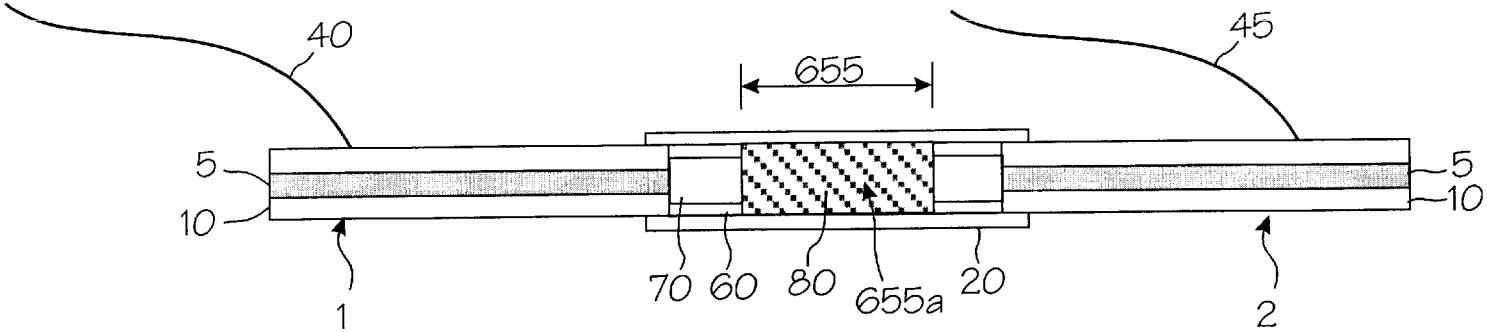
FIG. 6B is a longitudinal cross-section of an embodiment of the present invention having an in-line spark gap configuration with an explosive mixture and booster increments.

FIG. 6A illustrates an embodiment of the invention which is a linear ignition system having an in-line gap configuration with explosive material. The construction is similar to that shown in FIG. 4A, with metal-sheathed linear explosives 1 and 2 connected by sleeve 20 made of non-conductive material, the linear explosives 1 and 2 each including a sheath 10 and explosive material 5. The ends of linear explosives 1 and 2 are separated by a gap 650*a* of distance indicated by arrow 650, and the gap 650*a* contains explosive material 80. Upon application of voltage to and current passing through electrical contacts 40 and 45, a spark jumps the gap 650*a* and ignites explosive material 80, which in turn ignites the linear explosives 1 and 2. Likewise, the embodiment shown in FIG. 6B is similar to that shown in FIG. 4B, except that gap 655*a* indicated by arrow 655 contains explosive material 80 and the boosters 70 respectively surrounded by their metal sleeves 60 are placed on the ends of the linear explosives 1 and 2 inside sleeve 20 so that when current passes through electrical contacts 40 and 45 a spark jumps the gap 655*a* and ignites explosive material 80 so as to ignite the linear explosives 1 and 2 through boosters 70.

Figure 7A:
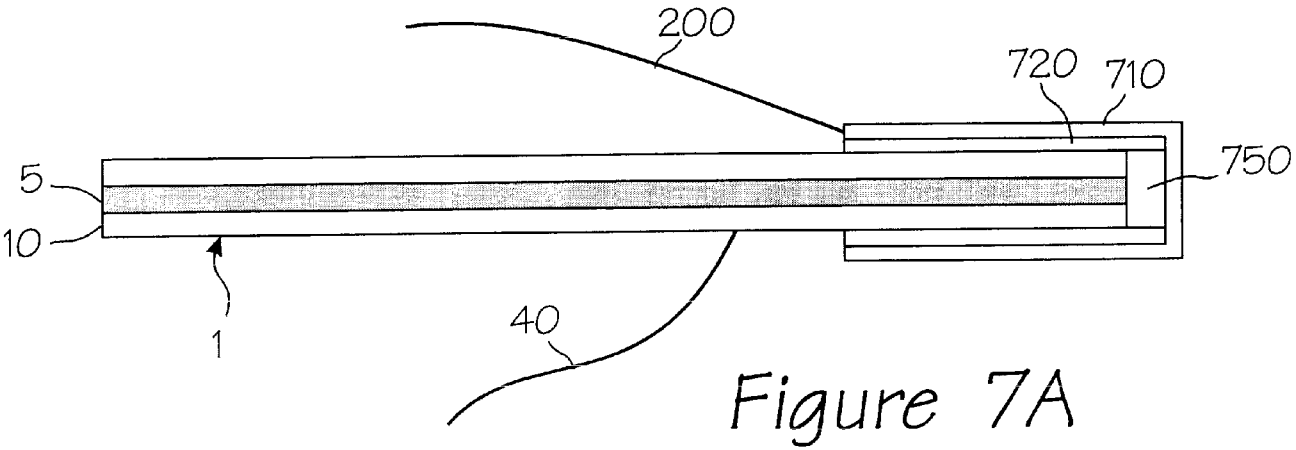
FIG. 7A is a longitudinal cross-section of an embodiment of the present invention having an end initiation configuration with a spark gap.
Figure 7B:
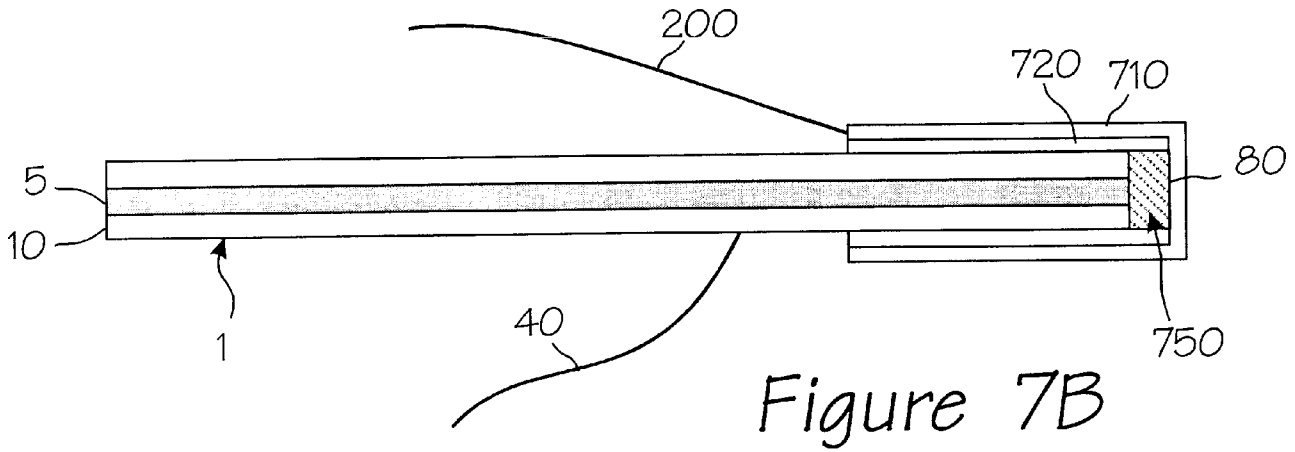
FIG. 7B is a longitudinal cross-section of an embodiment of the present invention having an end initiation configuration with a spark gap and explosive mixture.

FIG. 7A illustrates a linear ignition system embodiment having an end initiation air gap configuration. Here, on one end of linear explosive 1, the linear explosive 1 including a sheath 10 and explosive material 5, is insulating sheath 720 and metal end cap 710, which is installed to leave gap 750 between the end of the linear explosive 1 and the interior end of end cap 710. Gap 750 may, for example, be in the range of 0.020 to 0.050 inches. Electrical contact 200 is connected to end cap 710 and electrical contact 40 is connected to the sheath 10 of linear explosive 1, and upon application of electric current through the electrical contacts 40 and 200, a spark jumps gap 750 initiating the linear explosive 1. FIG. 7B illustrates an alternative embodiment of this configuration of FIG. 7A and includes the structure of the linear explosive 1 including a sheath 10 and explosive material 5, end cap 710, sheath 720, and electrical contacts 40 and 200, except that an explosive mixture 80 is placed in gap 750 that is ignited when a spark jumps gap 750 when current is applied through electrical contacts 40 and 200 to ignite the linear explosive 1.

Figure 7C:
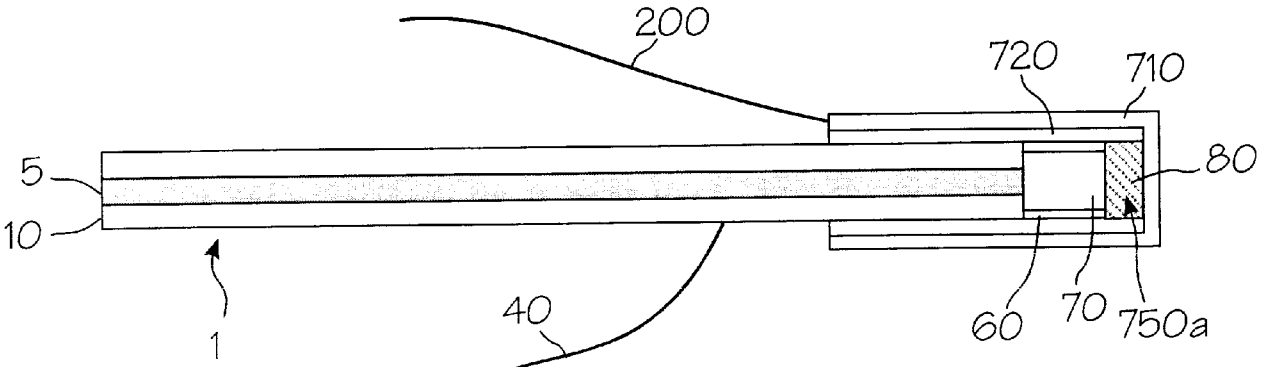
FIG. 7C is a longitudinal cross-section of an embodiment of the present invention having an end initiation configuration with a spark gap with explosive mixture and booster.
Figure 7D:
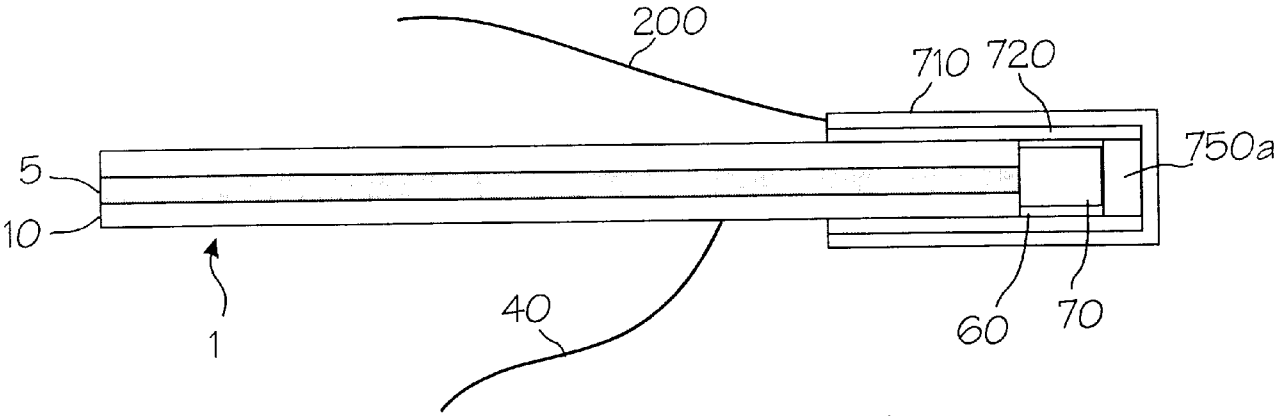
FIG. 7D is a longitudinal cross-section of an embodiment of the present invention having an end initiation configuration with a spark gap and booster.

FIGS. 7C and 7D illustrate embodiments using booster increment 70 to detonate the metal-sheathed linear explosive 1 containing explosive material 5. Metal sleeve 60 surrounds booster increment 70 and contacts sheath 10 of the linear explosive 1, and is surrounded in turn by insulating sheath 720 and metal end cap 710, with gap 750*a* separating the interior end of metal end cap 710 from the end of booster increment 70 and the end of metal sleeve 60. Gap 750*a* may be an air gap as shown in FIG. 7D, or gap 750*a* may contain explosive mixture 80, as shown in FIG. 7C. Again, in the embodiments of FIGS. 7C and 7D, upon application of electrical current to electrical contact 40 connected to sheath 10 and to electrical contact 200 connected to end cap 710, a spark jumps gap 750*a* from the end of metal sleeve 60 to the interior end of metal cap 710 to ignite the linear explosive 1 through booster 70 and, in FIG. 7C also through ignition of explosive material 80.

In general, as noted, the embodiments using booster increments will be used when detonation is required for initiating the linear explosive, generally the case when the linear explosive is a detonating material. The devices shown in the embodiments of the invention may be made at the site of use, but will generally be prepared and sold as completed units. For example, a linear deflagrating cord for use in an air-bag deployment system would be sold as the deflagrating cord with the linear initiation system integrated into the product. Thus, when installed into a vehicle, there would be no need to attach a separate initiator. Moreover, the initiation systems of the present invention are robust and very long-lived, and thus are ideal for applications such as crash safety systems where the pyrotechnic may sit for years unmaintained, but must still reliably initiate in an accident.

Thus, the linear ignition system of the present invention may be used in a wide range of applications. The system is ideal, for example, for the initiation of linear explosive or pyrotechnic devices used in automotive or commercial aircraft safety systems. Typical applications include rupture of structures to allow airbag deployment. Here, the linear explosives for a particular application would be custom manufactured including the linear ignition system, and installation would be considerably simpler than systems involving separate initiators.

The system could also be used in military applications such as aircraft aircrew escape and safety systems, for example canopy release, fracture or severance. Other military applications include weapon system or ammunition ignition, event sequencing and submunition dispensing. As numerous aerospace applications use linear explosives, the linear ignition system of the present invention may find use in launch vehicle event sequencing systems.

There are numerous other commercial applications for the present invention. These include commercial blasting, including building demolition, construction, road work, mining and quarrying, as well as oil field applications. While various embodiments of the present invention have been illustrated and described, it will be apparent to those skilled in the art that other modifications may be made without departing from the scope of the invention.

What is claimed is:

1. A linear ignition system, comprising:

a metal-sheathed linear explosive including a metal sheath and an end;

an electrically insulating sleeve surrounding a portion of the metal sheath of said metal-sheathed linear explosive near said end of said metal-sheathed linear explosive;

a metal end cap mounted over said electrically insulating sleeve forming a gap between said end of the metal-sheathed linear explosive and an inside surface of said metal end cap; and a first electrical contact connected respectively to the metal sheath of said metal-sheathed linear explosive and a second electrical contact connected respectively to said metal end cap.

2. The linear explosive ignition system of claim 1, further comprised of the dimension of said gap being in a range of approximately 0.020 to 0.050 inches.

3. The linear explosive ignition system of claim 1, further comprising:

an explosive mixture in said gap.

4. The linear explosive ignition system of claim 1, further comprising:

a booster increment adjacent to said end of said metal-sheathed linear explosive; and a metal sleeve surrounding said booster increment within the electrically insulating sleeve, said metal sleeve including one end of said metal sleeve electrically contacting the metal sheath of said metal-sheathed linear explosive, and with a spark gap forming said gap between the other end of said metal sleeve and the inside surface of said metal end cap, said spark gap for conducting a spark.

5. The linear explosive ignition system of claim 4, further comprising:

an explosive material in said spark gap.

6. A linear explosive ignition system, comprising:

a metal-sheathed linear explosive including a metal sheath and an end;

an electrically insulating sleeve surrounding a portion of the metal sheath of said metal-sheathed linear explosive near said end of said metal-sheathed linear explosive;

a metal end cap mounted over said electrically insulating sleeve and forming a gap between said end of the metal-sheathed linear explosive and an inside surface of said metal end cap;

a bridge extending across the gap within the metal end cap, with a first end of said bridge and a second end of said bridge respectively electrically coupling the metal sheath of said metal-sheathed linear explosive and said metal end cap to provide an electrical coupling between the metal sheath of the metal-sheathed linear explosive and said metal end cap; and a first electrical contact connected respectively to the metal sheath of said metal-sheathed linear explosive and a second electrical contact connected respectively to said metal end cap.

7. The linear explosive ignition system of claim 6, further comprised of:

said bridge being made of an exothermic metal composition.

8. The linear explosive ignition system of claim 6, further comprised of said bridge being made of Pyrofuze®.

9. The linear explosive ignition system of claim 6, further comprised of said metal-sheathed linear explosive being selected from any of a linear shaped charge, a mild detonating cord and a rapid deflagration cord.

10. The linear explosive ignition system of claim 6, further comprising:

an explosive mixture contained in said gap.

11. The linear explosive ignition system of claim 10, further comprised of:

said bridge being a hotwire bridge for igniting said explosive mixture.

12. The linear explosive ignition system of claim 6, further comprising:

a booster increment adjacent to said end of said metal-sheathed linear explosive within said gap.

13. The linear explosive ignition system of claim 12, further comprising:

a metal sleeve surrounding said booster increment within the electrically insulating sleeve, said metal sleeve electrically contacting the metal sheath of the metal-sheathed linear explosive adjacent to said end of said metal-sheathed linear explosive; and the electrical coupling between the metal sheath of the metal-sheathed linear explosive and the metal end cap comprising a connection between the first end of the bridge and said metal sleeve.

* * * * *